United States Patent [19]

Zocher

[11] 4,142,475

[45] Mar. 6, 1979

[54] BOBBIN THREAD CASE OPENER

[75] Inventor: Josef Zocher, Haaren, Aachen, Fed. Rep. of Germany

[73] Assignee: The Singer Company, New York, N.Y.

[21] Appl. No.: 863,550

[22] Filed: Dec. 22, 1977

[51] Int. Cl.[2] ..... D05B 57/22

[52] U.S. Cl. ..... 112/181; 112/231

[58] Field of Search ..... 112/181, 182, 189, 190, 112/228, 231

[56] References Cited

U.S. PATENT DOCUMENTS

| | | | |
|---|---|---|---|
| 2,138,939 | 12/1938 | Pudelko | 112/228 |
| 2,990,794 | 7/1961 | Ketterer | 112/228 |

FOREIGN PATENT DOCUMENTS

| | | | |
|---|---|---|---|
| 47-20106 | 6/1972 | Japan | 112/228 |

*Primary Examiner*—Wm. Carter Reynolds

*Attorney, Agent, or Firm*—Robert E. Smith; Edward L. Bell; William V. Ebs

[57] ABSTRACT

A lock stitch sewing machine having a rotary loop taker adapted to carry a loop of thread about a stationary bobbin thread case. The bobbin thread case is restrained from rotation by a finger which is disposed between abutments in the bobbin thread case for opening a passage to allow the needle thread loop past the bobbin thread case rotation restraining means, the rotation restraining finger is vibrated at a frequency greater than four cycles per rotation of the loop taker.

3 Claims, 3 Drawing Figures

BOBBIN THREAD CASE OPENER

BACKGROUND OF THE INVENTION

This invention relates to the opening of a gap for the passage of the needle thread between the nonrotating bobbin case of a rotary sewing machine loop taker and the rotation restraining means for the bobbin thread case. The gap between the position finger and the bobbin case, through which the thread has to pass just prior to stitch setting, tends to be closed due to the frictional forces caused by the rotating loop taker body during operation. This results in an interference with passage of the thread loop which can cause several sewing malfunctions, for example, the formation of loops in the resulting stitches, imperfect stitch setting, and thread breakage.

It is known in the sewing machine art to provide a bobbin thread case opener for the purpose of allowing the passage of the needle thread between the bobbin thread case and the bobbin case rotation restraining means. Conventional bobbin case opener employs two spaced bobbin case rotation restraining means relatively movable so as to be alternately effective and thus to provide for an escapement. In such conventional bobbin case opener mechanism, the timing of the opener drive is critical, and the spaced rotation restraining means double the chance of a problem arising as the thread passes there through.

SUMMARY OF THE INVENTION

It is the object of this invention to provide an improved bobbin thread case opener effective to allow the passage of the needle thread loop past the bobbin thread case rotation restraining means in a sewing machine. This is accomplished by restraining the bobbin thread case in only one place, and vibrating the restraining means at a frequency greater than four complete cycles for each revolution of the loop taker.

DESCRIPTION OF THE DRAWINGS

The accompanying drawings illustrate a preferred form of this invention in which.

DESCRIPTION OF THE PREFERRED EMBODIMENT

Figure 3:
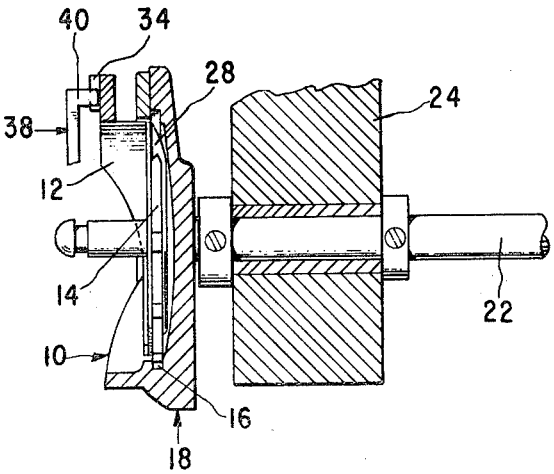
FIG. 3 is a cross section taken substantially along line 3—3 of FIG. 1.

Referring to FIG. 3 of the drawings, 10 illustrates a bobbin case which includes a bobbin case base 12 which is formed with a bearing rib 14 journaled in a raceway 16 formed in the rotary loop taker 18. The rotary loop taker 18 is mounted on a loop taker shaft 22 in the machine frame 24. A loop seizing beak 26 formed on the rotary loop taker serves to engage and draw out loops of needle thread manipulating such needle thread loops about an under thread supply in the bobbin case in the formation of each stitch. By providing a gap 28 in the bearing rib 14 and a gap 30 in the rotary loop taker raceway 16, and by preventing the base 12 from rotating with the rotary loop taker 18 so that the gaps 28 and 30 may periodically overlap, it will be appreciated that the needle thread loop can enter between the base 12 and the rotary loop taker 18 when the gaps 28 and 30 overlap, and after being drawn completely about the bobbin, the needle thread loop may be withdrawn from between the base 12 and the rotary loop taker 18 when the gaps 28 and 30 again overlap.

The bobbin case 10 is also provided with a bobbin case cover 32 which can serve many purposes such as that of latching the bobbin in place on the base 12, that of providing a smooth, snag-free outer shell over which the needle thread loop can pass, and that of supporting a bobbin thread tensioning means. The cover 32 and the base 12 together thus provide a bobbin case 10 which is required to be restrained against rotation with the rotating loop taker.

Figure 1:
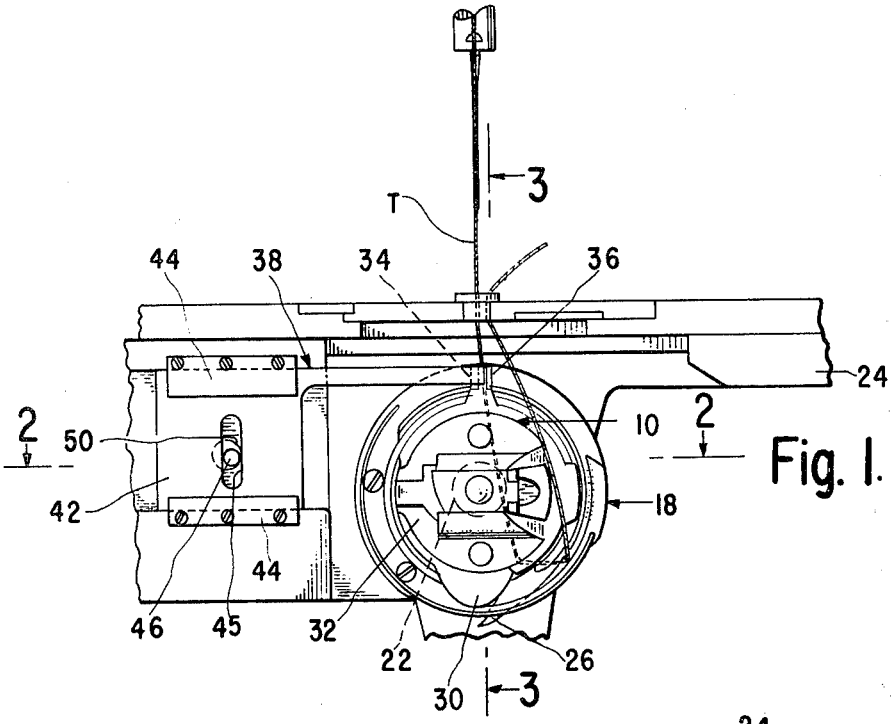
FIG. 1 represents a front elevational view of a lock stitch sewing machine loop taker showing the bobbin thread case opener and portions of the sewing machine frame as well as the needle and needle thread.
Figure 2:
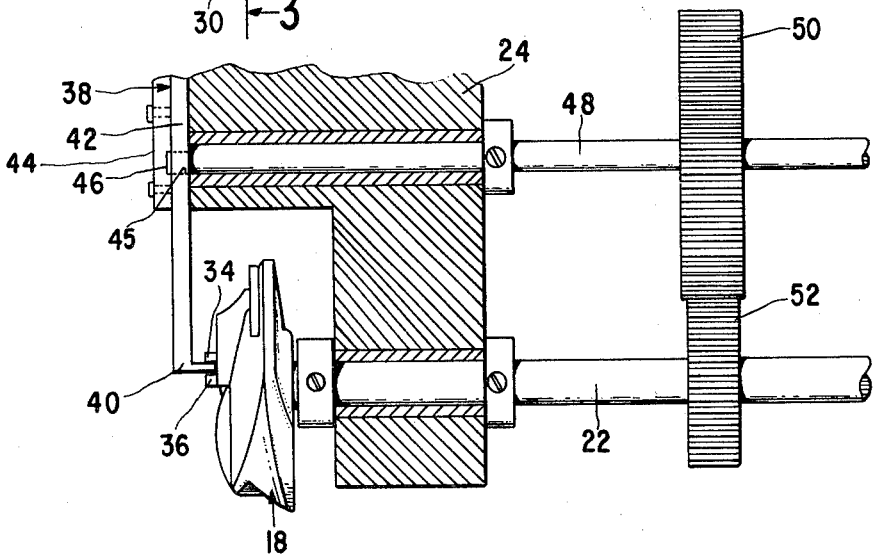
FIG. 2 is a top plan view of the loop taker and bobbin thread case opener of FIG. 1 with the sewing machine frame shown in section.

To provide for such rotation restraint as best illustrated in FIG. 1, the bobbin case 10 is formed with a pair of spaced abutments 34 and 36 each disposed substantially radially of the path of motion of the rotary loop taker and arranged facing each other. Cooperating with the spaced abutments 34 and 36 to provide the sole rotation restraint for the bobbin case is a rotation restraining arm 38 formed with a laterally extending stop member 40 arranged to extend between the spaced abutments 34 and 36 with a gap or clearance therebetween. Because of the frictional drag exerted by the rotating loop taker on the bearing rib 14, the abutment 34 will be forced against the stop member 40.

The rotation restraining arm 38 is formed integral with a bracket 42 which is slidably restrained between guide elements 44 secured to the frame 24. The bracket 42 is also formed with a vertical slot 45 which accommodates an eccentric pin 46 mounted on a drive shaft 48. The drive shaft 48 has a gear 50 mounted thereto, meshing with a gear 52 mounted on the hook shaft 22. Preferably the gearing 50, 52 will rotate the drive shaft 48 at a speed greater than four revolutions to every one revolution of the hook shaft 22. Therefore, the eccentric 46, which is arranged in the vertical slot 45 of the bracket 42, will drive the rotation restraining arm 38 in an reciprocatory motion at the same frequency at which the drive shaft 48 rotates. The laterally extending stop member 40, which is disposed with clearance between the spaced abutments 34 and 36, will thus vibrate between the spaced abutments 34 and 36 preferably at an amplitude less than the gap or clearance.

At very low sewing speeds, the bobbin case 10 can follow the oscillatory movements of the stop member 40 so that the abutment 34 will remain in contact therewith. Since the friction force will be exceedingly low at slow speeds, however, no serious impediment to thread loop passage will be experienced.

At higher sewing speeds, on the contrary the inertia of the bobbin case 10 will impede its movement so that the abutment 34 will no longer follow and remain in contact with the stop member 40. Instead, the spaced abutments 34 and 36 will oscillate relatively to the stop member repeatedly opening gaps therebetween through which the needle thread loop may pass freely.

Numerous alterations of the structure herein disclosed will suggest themselves to those skilled in the art. For instance, the stop member 40 may be driven from an electrical oscillator rather than from a mechanical drive connection to the drive shaft 22. Since no timed relation between the stop member vibration and loop taker movement would then exist, an oscillator should be chosen with a frequency at least four times greater than the maximum possible loop taker speed.

In order to keep the required driving energy small for parts oscillating with high frequency, it is of advantage to operate oscillating systems at or near the natural frequency (resonance frequency) of the bobbin thread case opener mechanism. In mechanically driven systems for oscillating the stop member to serve as a gap opener for a high speed lock stitch machine which depend on the operating speed of the sewing machine, the natural frequency can be varied by changing the length or the mass of the member 40 functionally coupled with the mechanical drive shaft 48.

For an electro-magnetically driven oscillating system using a selected oscillator for constant high frequency, it will be required to adjust the ratio of the driving frequency to the oscillating frequency electrically whereby this ratio will be kept substantially at 1 for obtaining the resonance frequency and also for optimizing the oscillating amplitude. Such electrical adjustment of the oscillating frequency may become necessary in order to compensate for variations in frictional forces and to maintain stable operating conditions.

Having thus set forth the nature of the invention, what is claimed herein is:

1. A bobbin thread case opener mechanism for a lock stitch sewing machine having a frame, an endwise reciprocatory thread carrying needle carried in said frame, a loop taker having a rotary path of motion in said frame cooperating with said needle, a bobbin case journaled relatively to said loop taker, and means for restraining rotation of said bobbin case including an abutment carried on said bobbin case and disposed radially of the rotary loop taker path of motion, a stop member for said bobbin case carried on said frame and constituting the sole rotation restraint for said bobbin case, said stop member being positioned for engagement with said abutment, and a means for imparting vibratory movement to said stop member relatively to said frame in a direction toward and away from said abutment at a frequency at least four times greater than the rate of rotation of said loop taker.

2. A bobbin thread case opener mechanism as set forth in claim in which said bobbin case includes spaced abutments each disposed substantially radially of the rotary loop taker path of motion and arranged facing one another, in which said stop member extends with clearance between said abutments, and in which said vibratory motion imparting means imparts vibration to said stop element of an amplitude less than the clearance between said stop element and said abutments.

3. A bobbin thread case opener mechanism as set forth in claim 1, in which the frequency of vibratory movement imparted to said stop element in maintained substantially equal to the resonance frequency of the oscillating bobbin thread case opener mechanism.

* * * * *